US009197004B2

(12) United States Patent
Kuo

(10) Patent No.: US 9,197,004 B2
(45) Date of Patent: Nov. 24, 2015

(54) ELECTRICAL CONNECTOR

(71) Applicant: HON HAI PRECISION INDUSTRY CO., LTD., New Taipei (TW)

(72) Inventor: Tzu-Fan Kuo, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 41 days.

(21) Appl. No.: 14/074,736

(22) Filed: Nov. 8, 2013

(65) Prior Publication Data

US 2014/0127923 A1 May 8, 2014

(30) Foreign Application Priority Data

Nov. 8, 2012 (CN) ..... 2012 2 0585541 U

(51) Int. Cl.

| | |
|---|---|
| ***H01R 13/40*** | (2006.01) |
| ***H01R 13/52*** | (2006.01) |
| *H01R 13/41* | (2006.01) |
| *H01R 24/60* | (2011.01) |

(52) U.S. Cl.

CPC ..... *H01R 13/5202* (2013.01); *H01R 13/521* (2013.01); *H01R 13/41* (2013.01); *H01R 24/60* (2013.01)

(58) Field of Classification Search

CPC .... H01R 24/00; H01R 13/40; H01R 13/5208; H01R 13/5205; H01R 13/533

USPC ..... 439/587, 589, 607.4, 607.35, 607.37, 439/567

See application file for complete search history.

(56) References Cited

U.S. PATENT DOCUMENTS

| | | | | |
|---|---|---|---|---|
| 5,145,410 | A * | 9/1992 | Maejima et al. | 439/587 |
| 6,095,860 | A * | 8/2000 | Gehrke et al. | 439/587 |
| 7,717,745 | B2 * | 5/2010 | He et al. | 439/607.23 |
| 8,251,717 | B2 * | 8/2012 | Liao et al. | 439/95 |
| 2006/0240710 | A1 * | 10/2006 | Kato et al. | 439/587 |

FOREIGN PATENT DOCUMENTS

| | | |
|---|---|---|
| CN | 202076578 | 12/2011 |

* cited by examiner

*Primary Examiner* — Abdullah Riyami
*Assistant Examiner* — Thang Nguyen
(74) *Attorney, Agent, or Firm* — Wei Te Chung; Ming Chieh Chang

(57) ABSTRACT

An electrical connector, comprises an insulative housing defining a number of receiving passages extending along a front-to-rear direction and throughout front and rear surfaces thereof. A plurality of contacts are received into the receiving passages of the insulative housing. And a hollow metallic shell encloses the insulative housing. An annular slot is formed between the insulative housing and the metallic shell, and a plurality of gaps are formed between the plurality of contacts and the corresponding receiving passages. The electrical connector further comprises a plurality of seals filled into the annular slot and the plurality of gaps.

8 Claims, 4 Drawing Sheets

ELECTRICAL CONNECTOR

BACKGROUND OF THE INVENTION

1. Field of the Invention

The present invention relates generally to an electrical connector, and more particularly to an I/O (input/output) port formed in an electrical device.

2. Description of the Prior Art

Some kinds of electrical connectors are widely used in personal computers, notebooks, multimedia players and other electrical devices for an I/O port to electrically connect with an external signal or power cable. In some environment, the electrical device needs to meet waterproof requirement. Thus, the electrical connector as an I/O port formed in the electrical device also needs to be waterproof.

Nowadays, an I/O electrical connector comprises an insulative housing defining a plurality of receiving passageways, a plurality of contacts received in the corresponding receiving passageways and a metallic shell enclosing the insulative housing. A plurality of rear ends of the contacts extends beyond a rear surface of the insulative housing. It should be noted that each of receiving passageway is not fully sealed by a corresponding contact. Thus, a gap is formed between a contact and a corresponding receiving passageway where the contact received into. In addition, a gap is also formed between the insulative housing and the metallic shell. During a using process of the electrical device, the water vapor or liquid will be entered into an internal room of the electrical device through above said gaps. As a result, the electrical device will be damaged and not work in a normal state.

Hence, in this art, an electrical connector to overcome the above-mentioned disadvantages of the prior art will be described in detail in the following embodiment.

BRIEF SUMMARY OF THE INVENTION

A primary object, therefore, of the present invention is to provide an electrical connector with simple structure and waterproof function.

In order to implement the above object and overcome the above-identified deficiencies in the prior art, an electrical connector comprises an insulative housing defining a plurality of receiving passages extending along a front-to-rear direction and throughout front and rear surfaces thereof. A plurality of contacts received into the receiving passages of the insulative housing. And, a hollow metallic shell encloses the insulative housing. An annular slot is formed between the insulative housing and the metallic shell, and a plurality of gaps are formed between the plurality of contacts and the corresponding receiving passages. The electrical connector further comprises a plurality of seals filled into the annular slot and the plurality of gaps.

Other objects, advantages and novel features of the invention will become more apparent from the following detailed description of a preferred embodiment when taken in conjunction with the accompanying drawings.

DETAILED DESCRIPTION OF THE INVENTION

Figure 1:
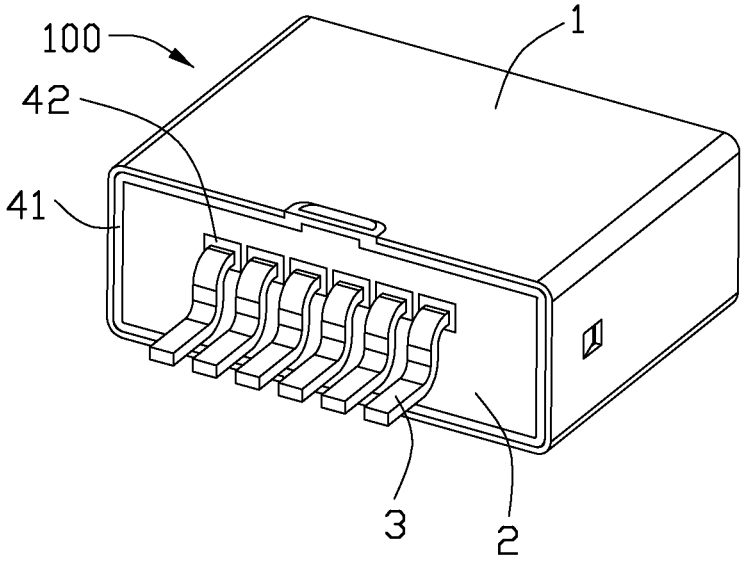
FIG. 1 is an assembled, perspective view of an electrical connector.

Reference will now be made in detail to a preferred embodiment of the present invention.

Referring to FIGS. 1 to 4, an electrical connector 100 comprises an insulative housing 2, a plurality of contacts 3 received into the insulative housing 2, a metallic shell 1 enclosing the insulative housing 2 and a plurality of seals 4 formed on a rear surface of the insulative housing 2.

Figure 3:
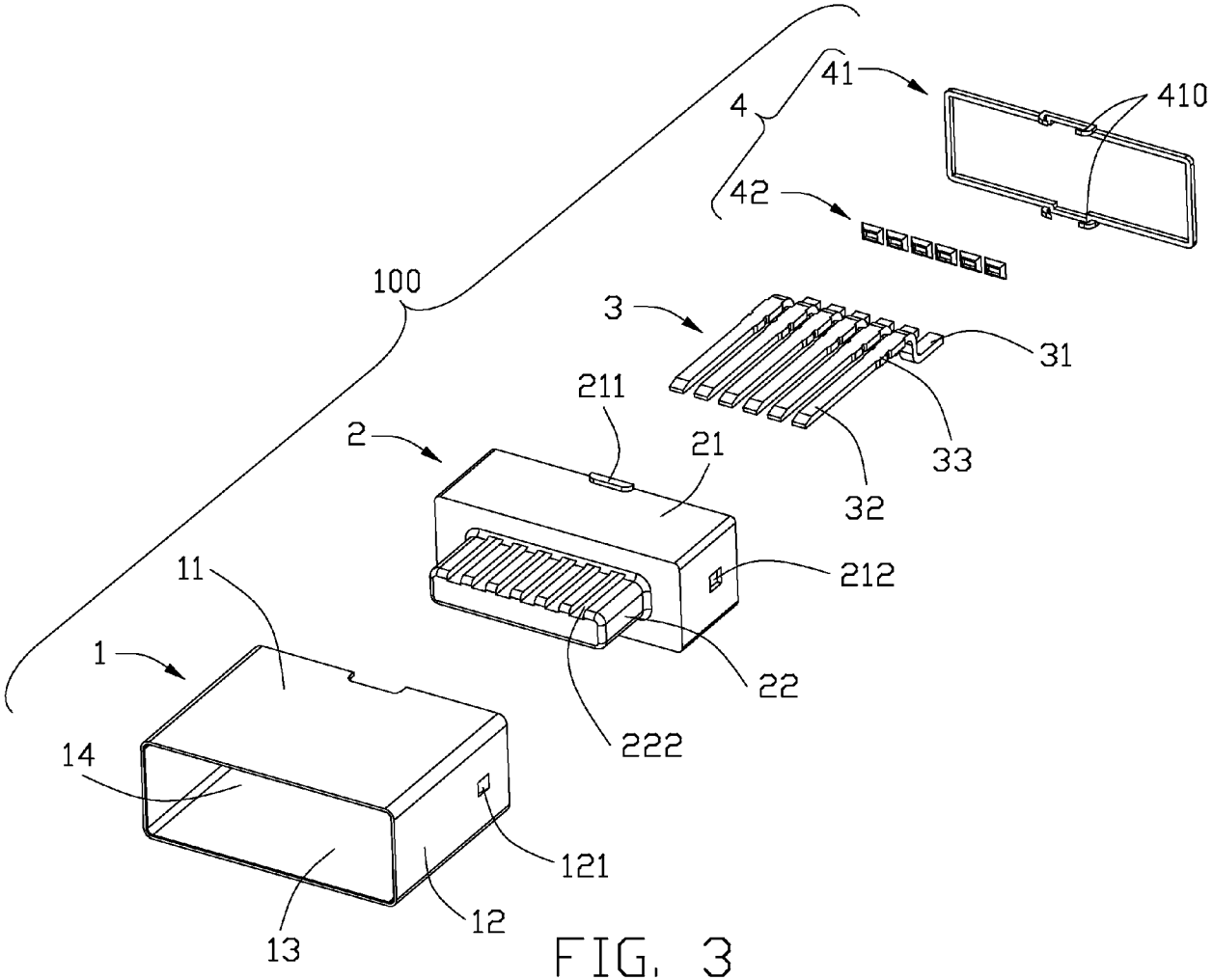
FIG. 3 is an exploded, perspective view of the electrical connector.
Figure 4:
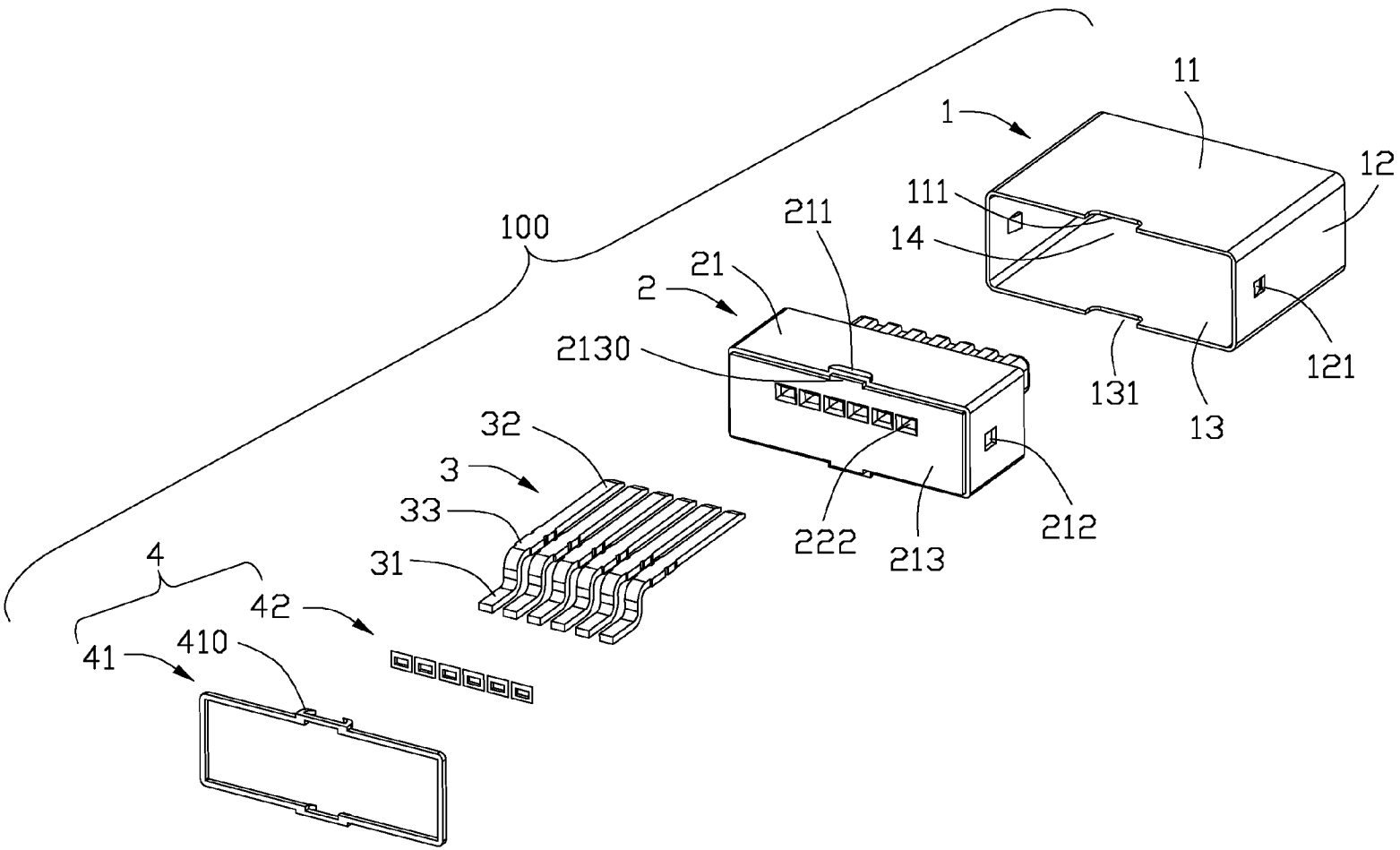
FIG. 4 is similar to FIG. 3, but viewed from another direction.

Referring to FIGS. 3 to 4, the metallic shell 1 comprises an upper wall 11, two side walls 12 respectively extending downwardly from two side of the upper wall 11 and a lower wall 13 connected to the two side walls 12 and paralleled with the upper wall 11. The upper wall 11 and the lower wall 13 respectively defines an indentation 111, 131 formed on a rear edge thereof. The metallic shell 1 defines a receiving cavity 14 formed by the upper wall 11, two side walls 12 and the lower wall 13 for receiving the insulative housing 2 and mating to a complementary connector (not shown). Each side wall 12 comprises an elastic tab 121 extending into the receiving cavity 14 for engaging with insulative housing 2.

Figure 2:
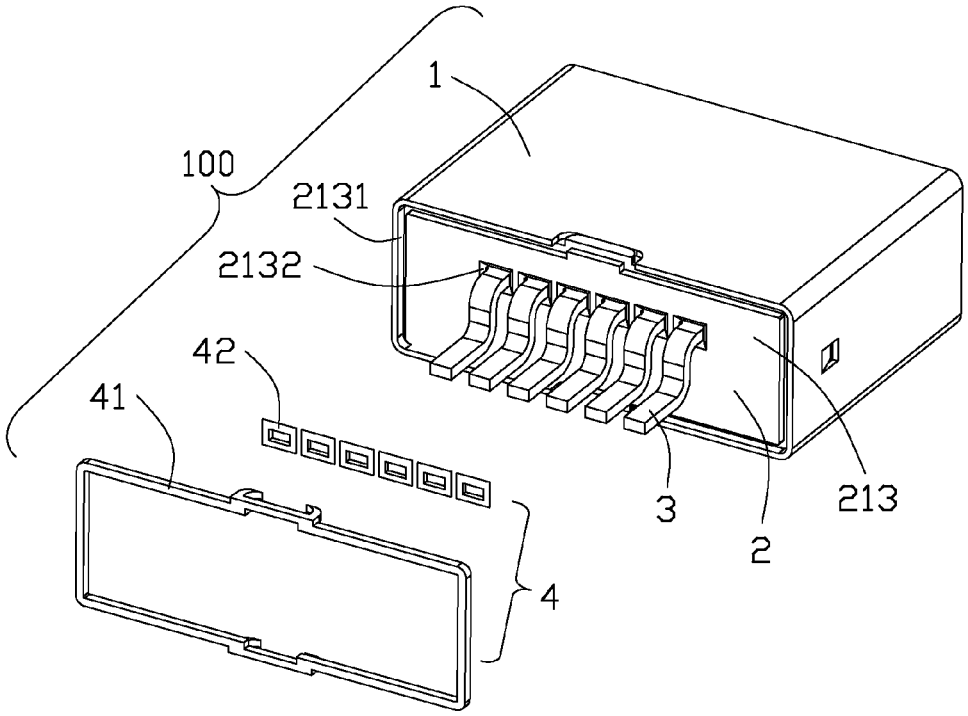
FIG. 2 is a partial exploded, perspective view of FIG. 1.

Referring to FIGS. 2 to 4, the insulative housing 2 comprises an elongated base portion 21 and a tongue portion 22 extending forwardly from the base portion 21. The base portion 21 defines two protrusions 211 respectively formed on a top and bottom surfaces thereof for cooperating with two indentations 111, 131. The base portion 21 further defines two recesses 212 formed on two lateral surfaces thereof for cooperating with two elastic tabs 121 to achieve an engagement between the insulative housing 2. The tongue portion 22 defines a plurality of passageways 222 formed on an upper surface thereof and extending to a rear surface of the insulative housing 2. The insulative housing 2 further comprises an emboss portion 213 extending rearwardly from a rear surface of base portion 21. The emboss portion 213 comprises two flanges 2130 respectively formed on top and bottom surfaces thereof. An annular slot 2131 is formed between the outer surface of the emboss portion 213 and the inner surface of the metallic shell 1. And, a plurality of gaps 2132 are formed between the contacts 3 and the corresponding receiving passages 222.

Referring to FIG. 3, each of contact 3 comprises a soldering portion 31 formed on a rear thereof, a mating portion 32 formed on a front end thereof and a retaining portion 33 connecting the soldering portion 31 and the mating portion 32.

Referring to FIGS. 2 to 4, a plurality of seals 4 comprise a first seal 41 filled into the first slot 2131 and a plurality of second seals 42 filled into the plurality of gaps 2132. The first seal 41 is structured in a rectangular frame. And each of the second seal 42 is also structured in a rectangular frame. The first seal 41 comprises a pair of arm portions 410 extending forwardly from a front surface of the first seal 41 and engaged with two protrusions 211 and two flange 2130 received in the indentations 111, 131.

Referring to FIGS. 1 to 4, the assembling process of the electrical connector 100 made in according to the present invention starts from assembling the plurality of contacts 3 to the insulative housing 2. The mating portion 32 and the retaining portion 33 of each of the contact 3 are both received into the passageway 222. And, the soldering portion 31 of each of the contact 3 extends rearwardly beyond the rear surface of the insulative housing 2. Then, the insulative housing 2 is inserted into the cavity 14 of the metallic shell 1 along a rear-to-front direction. At last, the first slot 2131 and the plurality of gaps 2132 are all filled with the first and second seals 41, 42. In this embodiment, the first seal 41 and the plurality of second seals 42 are made of glue. After the glue drying up. The first seal 41 seals the first slot 2131 located between the outer surface of the emboss portion 213, the second seals 42 seal the second slot 2132 located between the contacts 3 and the receiving passages 222. After the above assembling steps, the entire process of assembling of the electrical connector 100 is finished.

As the first slot 2131 and the second slot 2132 are respectively fully filled with the seal 4, so the water vapor or liquid will not be entered into an internal room of an electrical device through above said the first slot 2131 and the second slot 2132 of the electrical connector 100. Thus, the electrical connector 100 has waterproof function. At the same time, the electrical connector 100 has simple structure and easily to be manufactured.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector, comprising:

an insulative housing defining a plurality of receiving passages extending along a front-to-rear direction and throughout front and rear surfaces thereof;

a plurality of contacts received into the receiving passages of the insulative housing; and a hollow metallic shell enclosing the insulative housing; wherein a slot is formed between the insulative housing and the metallic shell, and a plurality of gaps are formed between the plurality of contacts and the corresponding receiving passages;

wherein the electrical connector further comprises a plurality of seals filled into the annular slot and the plurality of gaps; wherein the plurality of seals comprises a first seal filled into the slot and a plurality of second seals filled into the plurality of corresponding gaps; wherein the insulative housing comprises a base portion, a tongue portion extending forwardly from the base portion and an emboss portion extends rearwardly from the base portion, the slot is formed between the emboss portion and the metallic shell; wherein the metallic shell defines an upper wall, a lower wall and two lateral walls respectively connected with the upper wall and the lower wall, the upper and the lower wall respectively defines an indentation formed on a rear edge thereof; wherein the base portion defines two protrusions respectively formed on top and bottom surfaces and received into the two indentations, the emboss portion defines two flanges respectively formed on top and bottom surfaces and received into the two indentations.

2. The electrical connector as claimed in claim 1, wherein the plurality of seals are made of glue.

3. The electrical connector as claimed in claim 1, wherein the first and second seals are respectively structured in a rectangular frame.

4. The electrical connector as claimed in claim 1, wherein the first seal defines a pair of arm portions respectively extending into the two indentations and engaged with the protrusions and flanges.

5. The electrical connector as claimed in claim 1, wherein the base portion defines two recesses formed at two lateral surfaces thereof, the two lateral walls of the metallic shell defines two elastic tabs cooperated with the two recesses to achieve an engagement between the insulative housing and the metallic shell.

6. The electrical connector as claimed in claim 1, wherein each of contact comprises a mating portion received into the tongue portion for mating with a complementary, a retaining portion engaged with the mating portion and a soldering portion extending rearwardly from the retaining portion and beyond the rear surface of the insulative housing.

7. An electrical connector comprising: an insulative housing defining a plurality of passageways extending through a rear face of the housing with respective rear openings, said housing further defining a slot structure surrounding a periphery of the rear face; a plurality of contacts inserted into the corresponding passageways via said rear openings, respectively; a frame like metallic shell fully surrounding the housing except in a front face and the rear face, a rear edge of said metallic shell essentially flush with the rear face of the housing; and a sealing fills the slot structure so as to have the rear edge of the shell, the sealing and the rear face of the housing are essentially coplanar with one another, wherein the housing defines a first protrusion on a top wall thereof, and the shell defines a notch in a top plate therein, said protrusion being received in the notch with a gap filled with the sealing so as to prevent rearward movement of the sealing relative to the housing.

8. The electrical connector as claimed in claim 7, wherein the housing further defines a second protrusion on the rear face proximate the first protrusion to abut against the sealing to reinforce the sealing around the notch.

* * * * *